United States Patent [19]

Lisa

[11] Patent Number: 5,044,937

[45] Date of Patent: Sep. 3, 1991

[54] METHOD AND APPARATUS FOR CUTTING AND REMOVING STRAPS FROM STRAPPED ARTICLES

[75] Inventor: Mario Lisa, Poirino, Italy

[73] Assignee: L.I.T.A. S.r.l., Turin, Italy

[21] Appl. No.: 618,022

[22] Filed: Nov. 26, 1990

Related U.S. Application Data

[63] Continuation of Ser. No. 471,568, Jan. 29, 1990, abandoned.

[30] Foreign Application Priority Data

Jan. 31, 1989 [IT] Italy ..... 67055 A/89

[51] Int. Cl.[5] ..... F27D 5/00

[52] U.S. Cl. ..... 432/5; 29/127; 432/6; 432/59

[58] Field of Search ..... 432/5, 6, 59; 29/127

[56] References Cited

U.S. PATENT DOCUMENTS 3,513,522 5/1970 Thompson ..... 29/200

4,545,761 10/1985 Cartwright et al. ..... 432/5

FOREIGN PATENT DOCUMENTS 0240289 9/1988 European Pat. Off. .

*Primary Examiner*—Henry C. Yuen

*Attorney, Agent, or Firm*—Sughrue, Mion, Zinn, Macpeak & Seas

[57] ABSTRACT

A strap binding a plurality of articles together is automatically cut and removed by gripping the strap between two counter-rotating rollers and cutting the strap by using an oscillating cutting blade. The two counter-rotating rollers are then operated to advance the cut end of the strap into a cylindrical recess of a collecting device to cause the strap to be coiled up within the recess. The coiled strap which is of a thermo-fusable material is then heated locally to cause adhesion between the adjacent turns. The coiled strap which is now in a stable, coiled condition, is then ejected from the apparatus.

33 Claims, 3 Drawing Sheets

METHOD AND APPARATUS FOR CUTTING AND REMOVING STRAPS FROM STRAPPED ARTICLES

This is a continuation of application Ser. No. 07/471,568 filed Jan. 29, 1990, now abandoned.

BACKGROUND OF THE INVENTION

In general, the present invention tackles the problem of the removal of straps from articles which are strapped together and has been developed with particular attention to its possible use for the removal of straps from stacks of signatures and similar products (papers, magazines, etc.) in the printing and publishing industry. In this field of application, the products discharged from printing and folding lines are currently collected in stacks of superposed products which are bound together in their direction of stacking by straps, usually with two rigid boards positioned so as to protect the two ends of the stack. This is all with a view to storage (and possible transportation) as piles of stacks collected on pallets.

For subsequent handling of the products (for example, binding, bookbinding, etc.) it is necessary to remove the straps and the two end retaining boards.

Conventionally, this operation is carried out manually after the stacks have been placed on a conveyor which supplies them to the subsequent handling station. The fact that this operation is carried out manually makes it quite demanding and onerous, particularly in large printing and publishing plants where the production volumes may require the employment of a considerable number of personnel, and especially if the plant operates a continuous cycle with several shifts.

SUMMARY OF THE INVENTION

The object of the present invention is to provide a method and apparatus which enable the straps to be removed automatically with a high degree of precision and reliability.

According to the present invention, this object is achieved by virtue of a method and/or apparatus having the characteristics recited specifically in the claims which follow.

BRIEF DESCRIPTION OF THE DRAWINGS

The invention will now be described, purely by way of non-limiting example, with reference to the appended drawings, in which.

DETAILED DESCRIPTION OF THE DRAWINGS

Figure 1:
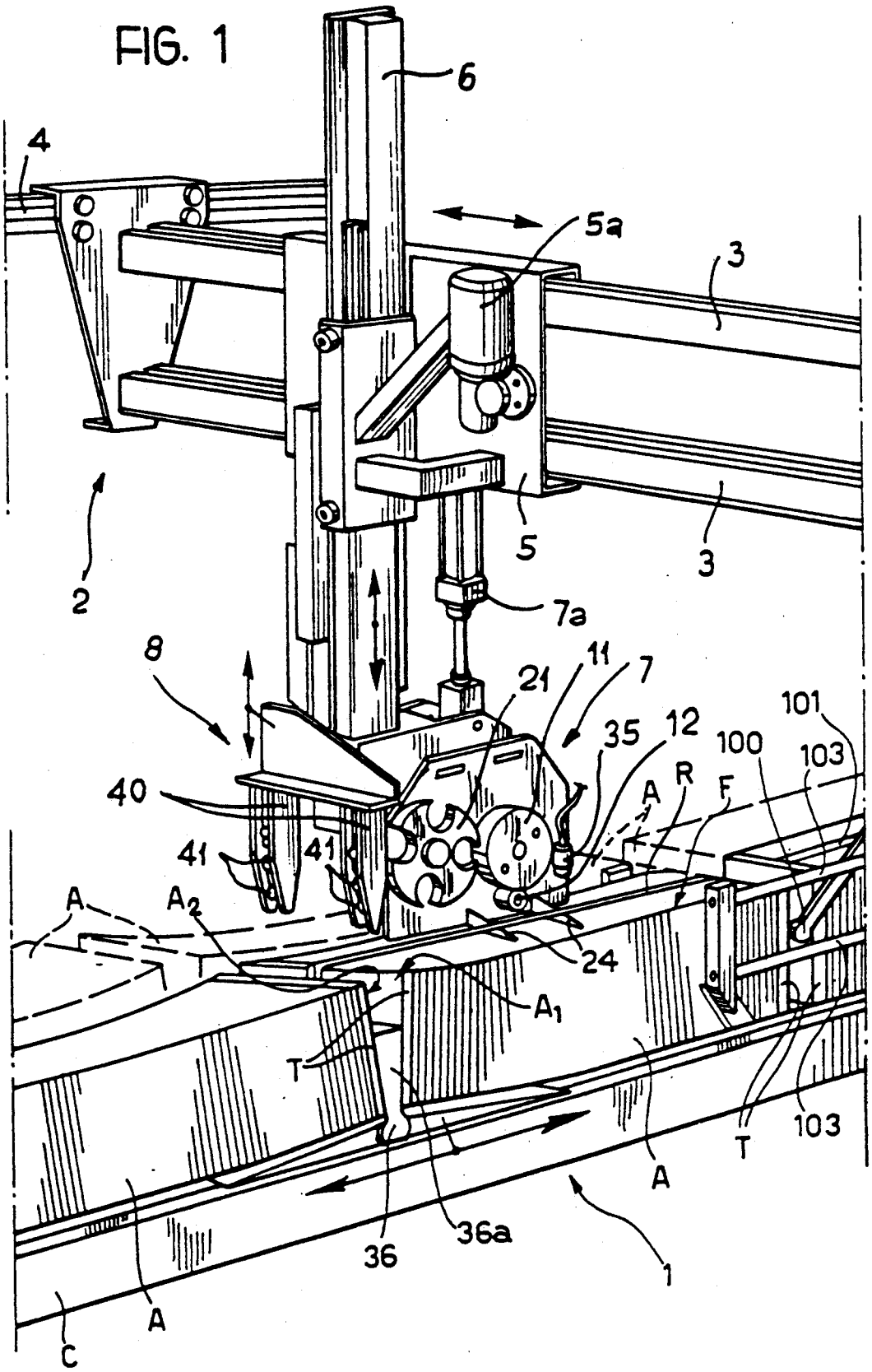
FIG. 1 is a general perspective view of apparatus according to the invention.

FIG. 1, apparatus for use in removing straps from articles which are strapped together is generally indicated. 1.

In the embodiment illustrate, the articles in question are constituted by stacks A of signatures or similar products (papers, magazines, etc.) stacked between two end boards T and bound by straps R, usually of thermofusible plastics material.

In the embodiment illustrated, the articles A advance horizontally (from right to left from the viewpoint of FIGS. 1 and 2) on a conveyor C, such as a roller conveyor, towards a handling station (for example, a binding station) not shown in the drawings.

In general, the articles A advance in several parallel flows which are side by side, as shown schematically in FIG. 1 where the articles A advancing in a further flow behing the articles A visible in the foreground are shown schematically in broken outline.

In the embodiment illustrated, the apparatus 1 has a generally cartesian-robot-like configuration with a portal-shape support structure 2 arranged above the advancing flows of articles in the manner of a bridge. The structure 2 includes a cross member 3, usually constituted by two superposed rails, extending transverse and above the flow of articles A to connect two lateral guides 4.

The cross member 3 can move along the lateral guides 4 of the portal structure (only one of which is visible in the views of FIGS. 1 and 2 under the action of motor means, not illustrated), so that it can, so to speak, follow the articles A as they advance.

A motor-driven carriage 5 (motor 5*a*) is in turn mounted for sliding on the rails 3, for example, on rollers or bearings, and can be brought selectively above any one of the advancing flows of articles A.

An upright or vertical column 6 is mounted on the carriage 5 and two units which constitutes the actual active parts of the apparatus according to the invention can slide vertically along it (towards and away from the articles A).

More precisely, these are units, generally indicated 7, for removing the straps R and coiling them up and units, generally indicated 8, for picking up and removing the boards T.

The units carry associated operating members (for example, fluid jacks such as the one indicated 7*a* in FIGS. 1 and 2) which enable them to be lowered and raised (independently if necessary) relative to the advancing flows of articles A.

A conveyor mounted on the top part of the portal structure 2 is indicated 9 and is constituted, for example, by a roller conveyor extending parallel to the cross member 3. The conveyor 9 is fixed to the lateral uprights of the portal structure 2 and has the function of taking away and consequently recovering the boards T picked up by the unit 8. In fact, this unit can lower itself periodically (according to criteria which will be described further below) towards the flows of artices A so as to remove the boards T in pairs and then feed them to the conveyor 9 as a result of the translation of the cross member 3 towards the conveyor 9. The boards T thus collected can be advanced to a collection station so that they can be recovered and reused for the formation of new stacks.

Figure 3:
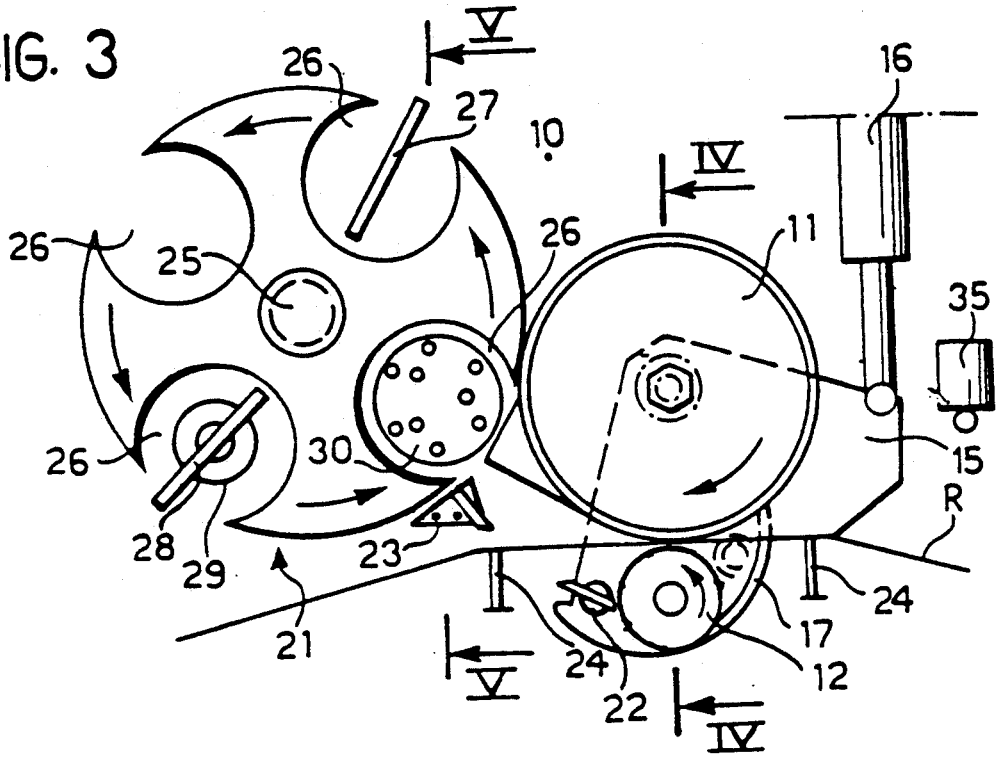
FIG. 3 shows the elements indicated by the arrow III of FIG. 2 on an enlarged scale.
Figure 4:
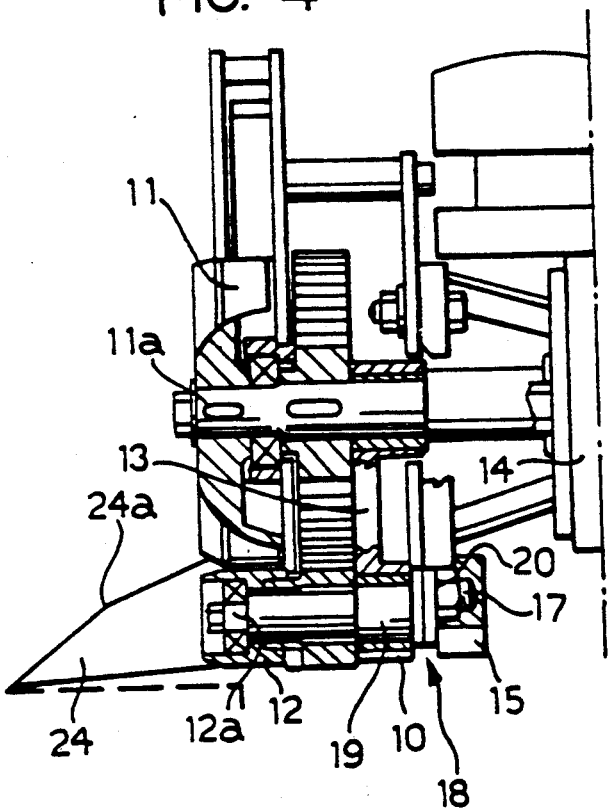
FIG. 4 is a section taken on the line IV-IV of FIG. 3.
Figure 5:
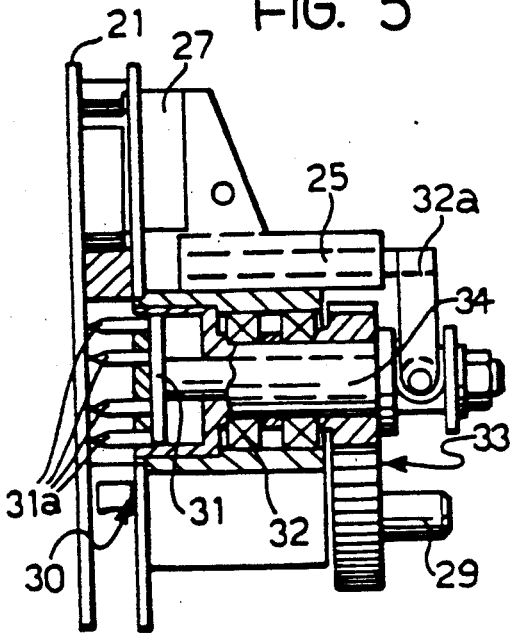
FIG. 5 is a section taken on the line V—V of FIG. 3.

As can be seen better in the detailed drawings of FIGS. 3 to 5, the unit 7 is constituted essentially by a support 10 on which two superposed rollers 11 and 12 are mounted. The rollers in question are keyed to respective horizontal shafts 11*a* and 12*a* which are interconnected by a gear 13 dimensioned so that the tangential velocities of the facing peripheral surfaces of the two rollers 11 and 12 are identical.

In general, the upper roller 11 has a larger diameter (for example, approximately 3 times larger) than the lower roller 12.

The rollers are rotated (the upper roller 11 clockwise and the lower roller 12 anticlockwise) by a motor, schematically indicated 14 in FIG. 4.

A movable element, generally indicated 15, can oscillate to and fro about the axis of the upper roller 11, that axis being defined by the shaft 11*a*, under the action of a fluid jack 16, according to criteria which will be described further below.

Figure 2:
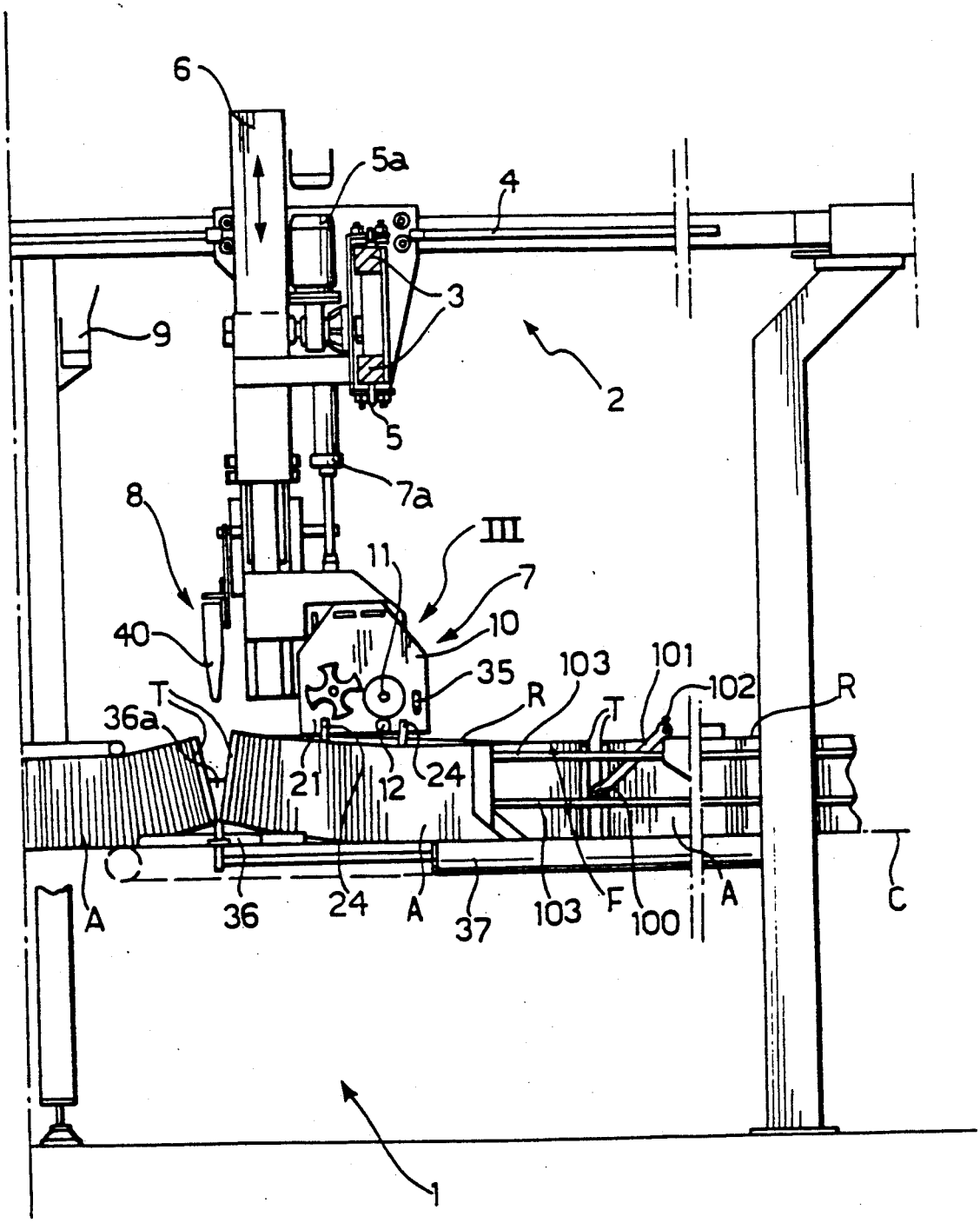
FIG. 2 is a side elevational view of the same apparatus.

The element 15 is arranged in a position generally behind the rollers 11 and 12 from the viewpoint of FIGS. 1 and 2. On its side facing the lower roller 12, it has an arcuate slot or track 17 whose function is to drive, as a result of the oscillation of the element 15, an eccentric assembly 18 on which the shaft 12*a* supporting the roller 12 is mounted.

The mechanism (see FIG. 4) comprise essentially a core 19 mounted rotatably on the support 10 in a position slightly offset from the axis of the roller 12, and a crank arm 20 with a free end which cooperates slidingly, for example, with the interposition of a bearing, with the slot or track 17 provided in the oscillating element 15.

A blade 22 is also mounted on the same element in a position generally facing a wheel-like structure 21, whose function will be described further below, and is intended to cooperate with a blade 23 mounted in a generally fixed position relative to the support 10.

The lower roller 12 is arranged in a position generally intermediate two wedge formations 24 which project in the manner of a forked guide from the outer side of the support 10. The wedge formations 24 have respective upper sides 24*a* whose inner ends (relative to the support 10) are substantially in horizontal alignment with the gap defined by the rollers 11 and 12.

The wheel structure 21 is mounted for rotation (under the action of motor means not directly visible in the drawings) about a horizontal shaft 25.

The wheel device 21 has a generally cross-like configuration and has four circular recesses 26 defined by respective cylindrical peripheral walls. The recesses 26 open outwardly of the wheel 21 and therefore have respective openings accessible from outside the wheel structure 21, radially thereof.

The openings of the recesses 26 are intended sequentially to face the region where the fixed blade 23 is situated, immediately above the blade itself, according to criteria which will be described further below.

A heating unit, for example, an armoured bar reisistor, indicated 27, is mounted on the support 10 so as precisely to face one of the recesses 26 when the recess 26 immediately upstream (in th anticlockwise sense of rotation of the wheel 21 from the viewpoint of FIG. 4) faces the blade 23.

A thrust element, indicated 28, also constituted by a bar is situated in a positions more or less opposite the heater element 27 relative to the shaft 25 so that it extends generally diametrally of another of the apertures 26 in the wheel structure 21.

The mounting arrangement described, therefore, is such that, when one of the recesses 26 faces the blade 23 (so that it can receive a strap according to criteria which will be described further below), the recess 26 immediately downstream (in the sense of rotation of the wheel 21) faces the heater element 27 and another recess 26 further downstream (by one or, as in the case of the embodiment illustrated, by two positions) faces the ejector element 28. The latter is mounted on an operating element, such as, for example, the rod of another fluid jack 29, so that it can be extended selectively through the recess 26 which faces it to eject a strap R which is coiled up in the recess according to the criteria which will be described further below.

A further wheel structure, indicated 30, is mounted in a position generally facing the blade 23 so as to be aligned precisely with the recess 26 of the wheel 21 which is in the same position at the same time.

As can be seen better in the sectional view of FIG. 6, the wheel structure 30 is constituted by a circular disc 31 from which a plurality of prongs 31*a* extend axially of the recess 26 aligned with the structue 30 at the time in question. The disc 31 is mounted on a shaft 32 which can be rotated (in an anticlockwise sense from the viewpoint of FIG. 3) through a gear 33 by a motor (possibly also constituted by the motor 14 which rotates the rollers 11 and 12), not shown. More precisely, the shaft 32 is mounted for longitudinal sliding in a sleeve 34 driven by the gear 33. The presence of longitudinal splines or grooves ensures that the shaft 32 is rotated by the sleeve 34. This arrangement enables the shaft 32 to slide longitudinally under the action of a control arm 32*a*, for example, a fluid actuator, so that it can move between an advanced position in which the prongs 31*a* extend into the circular or cylindrical recess 26 with which the wheel structure 30 is aligned, and a retracted position in which the prongs are disengaged from the recess to enable the wheel structure 21 to rotate freely about the shaft 25.

A sensor (for example, an optical sensor) for detecting the presence of a strap R between the two rollers 11 and 12 is indicated 35 and is mounted on the support 10 beside the rollers 1 and 12 on the opposite side from the wheel structure 21.

A slider, generally indicated 36, can move freely along the conveyor C under the action of an entrainment member 37, for example, of the type with a jack.

The slider 36, whose general outline is in the form of an isosceles triangle, has the function of moving beneath the stacks A until it is situated in a central position between the boards T applied to the facing ends $A_1$ and $A_2$ of the two successive stacks in the flow.

The insertion of the slider 36 between the successive stacks causes the ends $A_1$ and $A_2$ in question to be lifted from the transporting plane of the conveyor C which in turn results in:

- the bending of the two stacks affected by the action of the slider 36, and
- the moving apart of the two ends $A_1$ and $A_2$ and of the boards T applied thereto into a generally V-shaped configuration. The boards T may be stabilised in this opened position as a result of the penetration between them of two side arms 36*a* which project upwardly from the slider 36 in a generally U-shaped configuration.

From an observation of the stack situated immediately upstream of the slider 36 (in the direction of advance of the articles A), it can be seen that the presence of the slider 36 and the consequent raising of the downstream end ($A_1$) causes the formation of a curved (concave) upper side F in the stack (since the articles in question are stacks of superposed laminar products) and the consequent separation of the strap R from the side F.

When the strap R has been separated from the side F, the unit 7 is lowered towards the article A, and the two wedge formations 24 are then inserted between the strap R and the side F (for example, as a result of the sliding of the carriage 5 towards the article A).

This penetration or insertion brings the strap R into the space or gap between the rollers 11 and 12 (see FIG. 3 in particular).

Under these conditions, the strap R is also situated in a position intermediate the two blades 22 and 23.

The arrival of the strap R between the two rollers 11 and 12 (which are kept slightly apart) and between the two blades 22 and 23 is detected by the optical sensor 35 which (by means of a central control unit such as a microprocessor or a PLC of known type) activates the motor 14 so that the rollers 11 and 12 are rotated (clockwise for the roller 11 and anticlockwise for the roller 12).

Substantially simultaneously, the control unit also activates the jack 16 so as to cause the element 15 to swing from right to left from the viewpoint of FIG. 3.

This swinging movement displaces the slot or track 17 relative to the eccentric mechanism 18, causing the roller 12 (which at first was at a certain distance from the roller 11) to move towards the roller 11 and the consequent gripping of the strap R between the two rollers.

At the same time, the swinging of the element 15 also causes the movable blade 22 to swing towards the blade 23, which is in a fixed position, so as to effect a shearing action on the strap R and hence to cut it.

The rotation of the rollers 11 and 12 pushes the free end of the strap thus formed towards the opening of the recess 26 which is immediately opposite, downstream of the fixed blade 23.

The cut strap R is then rapidly removed from the position in which it is wrapped round the article A and advances into the coiling recess 26 into which the prongs 31*a* of the disc 31 extend. The disc is rotated by means of the gear 33 so that the strap R is coiled up in the recess 26 around the prongs 31*a*. These are then retracted, leaving the strap R which has been removed from the article A coiled up in the recess 26.

At this point, the wheel structure 21 advances by one step, bringing the coiled strap into correspondence with the heating element 27, whilst the recess 26 is brought to a position facing the blade 23 so that it can receive a new strap R removed from a subsequent article.

At the same time, the movement of the rollers 11 and 12 is stopped and the device 15 is returned to its rest position shown in FIG. 3, separating the blade 22 from the blade 23 and returning the lower roller 12 to a position a certain distance from the upper roller 11 to re-establish the gap in which a subsequent strap R can be gripped.

At the sme time, as a result of heating by the element 27, the strap already removed is melted locally (in correspondence with one of the two opposite faces of the loop) causing adjacent turns to stick firmly together.

Thus, when the strap is situated in correspondence with the ejector device 28 as a result of successive rotations of the wheel structure 21, the ejector device can discharge it from the apparatus in the form of an annular body of substantially stable shape, without any risk of the strap uncoiling and hence without causing collection problems, and particularly without interfering with the operation of the apparatus.

The unit 8 for picking up the board T operates in synchronism with the unit 7 by checking when the strap R on the article A upstream of the slider 36 has been removed (obviously, the strap has already been removed from the article A downstream): when this has taken place, both the boards T situated at the ends $A_1$ and $A_2$ which are kept raised and apart by the slider 36 can safely be removed since they are no longer held by the straps R.

In one possible embodiment, the unit 8 is constituted essentially by a forked structure with two vertical prongs 40 which project downwardly. The prongs 40 have slightly tapered lower ends on which gripping elements, such as suction cups 41 connected to a vacuum source, not shown, are mounted.

The unit 8 inserts its prongs between the ends $A_1$, $A_2$ and picks up the two boards T applied thereto by the suction cups 41. The boards are then removed upwardly as a result of the general movement of the unit 8 back to its rest position and are then inserted on the conveyor 9 for subsequent outward transfer.

Generally, in order to facilitate the separation achieved by the slider 36 and the insertion of the forked structure 40 between two consecutive stacks, it is preferable that the stacks are spaced slightly apart beforehand at a position upstream. A spacer unit is beforehand at a position upstream. A spacer unit is provided for this purpose and is constituted essentially by a horizontal roller or bar 100 supported at at least one end by a pivoting arm 101 carried by a device 102 which is movable longitudinally of the stacks on horizontal guides 103. The device 102, and hence the separator roller 100, is moved along the guides 103 by an operating member, such as a jack (not visible on the drawings), so as to move back (to a furthest back position) behind the last stack advanced towards the unit 7 at the time in question. When this furthest back position has been reached, the roller 100 falls by gravity behind the board T covering the rear end of the stack and is positioned to push the stack.

At this point, the movable device 102 is moved forwardly towards the unit 7 again to advance the stack and, at the same time, another stack can be supplied to the apparatus: this will in any case be kept apart from the preceding stack by the roller 100.

The space thus formed facilitates the insertion of the slider 36 from below and the consequent V-shaped separation of the facing ends.

When the position for the insertion of the slider 36 has been reached and the arms 36*a* which keep the ends $A_1$ and $A_2$ firmly apart have been operated, the movable device 102 is brought back to its initial position and the roller 100 is removed upwardly, sliding over the front—inclined—face of the stack next to the one which was pushed previously.

The synchronisation of there movements is ensured by an optical detector on the slider 36 which also provides the control signal that calls for the operation of the unit for removing the straps and the boards.

What is claimed is:

1. A method of removing straps from strapped articles, including the steps of:

gripping a strap which binds a strapped article, by means of gripping means, cutting the strap gripped by said gripping means, positioning a collecting means having a collecting recess to substantially face the gripping means, said collecting recess having a cylindrical peripheral wall and an opening through which said strap is intended to be inserted, moving the gripping means to advance the cut strap gripped by the gripping means along a direction substantially tangential to the peripheral wall of the recess to cause the strap to be coiled up within the recess.

2. A method according to claim 1, wherein it includes the step of providing gripping means in the form of two counter-rotating rollers which can grip the straps between them and substantially simultaneously advance them into the coiling recess.

3. A method according to claim 1, for removing straps of thermofusible material, wherein it includes the step of heating the straps coiled up in the recess, at least locally, to cause adhesion between adjacent turns so that the coiled straps assume a substantially stable coiled configuration.

4. A method according to claim 1, applied to articles having a certain length between two opposite ends, wherein it includes the steps of:

positioning the articles in a substantially horizontal position prior to the gripping of the straps, with at least one of the two opposite ends raised so as to bend the articles and consequently to render concave one side of the articles in correspondence with which the straps are spaced from the articles, and gripping the straps in correspondence with the concave sides of the articles.

5. A method according to claim 1, applied to articles constituted by stacks of items held together by straps in the direction in which they are stacked between two opposite ends and having retaining boards around which the straps pass applied to the ends, wherein it includes the steps of:

suppling the articles in sequence to the gripping means in a direction parallel to the direction in which they are stacked.

moving the facing ends of two consecutive articles in the sequence slightly apart, the respective straps having been removed from the two consecutive articles, and removing the retaining boards applied to the facing ends.

6. Apparatus for removing straps from strapped articles, including:

gripping means for gripping a strap which bound a strapped article, cutting means for cutting the strap gripped by said gripping means, collecting means including at least one recess having a cylindrical peripheral wall and provided with an opening through which the strap gripped by said gripping means and cut by said cutting means is intended to be inserted, said recess being capable of being positioned to substantially face the gripping means, and drive means for advancing a cut strap gripped by the gripping means which has been cut by said cutting means into the recess along a direction substantially tangential to the peripheral wall of the recess to cause the strap to be coiled up within the recess.

7. Apparatus according to claim 6, wherein the gripping means comprise two counter-rotating rollers which can grip the straps between them and then advance them into the coiling recess as a result of their rotation.

8. Apparatus according to claim 6, wherein the cutting means comprise;

a first blade situated in a position generally intermediate the gripping means and the coiling recess, and a second blade which can reciprocate between a rest position which it assumes at least when the straps are gripped by the gripping means and a cutting position in which the second blade cooperates with the first blade to cut the straps.

9. Apparatus according to claim 8, wherein fluid-actuator means are associated with the second blade.

10. Apparatus acccording to claim 7, wherein it includes:

an oscillating element which can move orbitally about the first roller and carries the second blade so as to move the second blade between its rest position and its cutting position, and movement-tansmission means interposed between the oscillating element and the second roller so that, as a result of the movement of the element, a relative movement of the rollers takes place between a spaced-apart position for receiving the straps between the rollers and a close-together position for gripping the straps between the rollers, the close-together position being reached at substantially the same time as the second blade reaches the cutting position.

11. Apparatus according to claim 10, wherein the movement-transmission means comprises track means on the oscillating element and a crank mechanism including a core rotatable about a respective axis, the second roller being mounted on the core in an eccentric position relative to the respective axis, and an operating arm with a free end which cooperates slidingly with the track means.

12. Apparatus according to claim 6, wherein the peripheral wall of the at least one coiling recess is substantially circular.

13. Apparatus according to claim 6, wherein it includes a formation with prongs which can extend through the coiling recess to facilitate the coiling up of the straps.

14. Apparatus according to claim 13, wherein the pronged formation extends axially of the recess and is rotatable in the coiling recess.

15. Apparatus according to claim 13, wherein the prongs are selectively retractable from the recess.

16. Apparatus according to claim 6, for removing straps of thermofusible material, wherein it includes heater means which can heat the straps coiled up in the recess, at least locally, so as to cause adhesion between adjacent turns whereby the coiled straps assume a substantially stable coiled configuration.

17. Apparatus according to claim 16, wherein it includes a wheel structure which defines a plurality of coiling recesses and can rotate so as to bring a recess which initially faces the gripping means in order to receive a strap for coiling to a position facing the heater means so that the previously coiled strap can be heated at least locally.

18. Apparatus according to claim 6, wherein it includes an ejector device for ejecting the straps from the coiling recess.

19. Apparatus according to claim 17, wherein the wheel structure includes at least three coiling recesses in an arrangement such that, at the same time, a first recess faces the gripping means, a second recess faces the heater means, and a third recess faces an ejector device for ejecting the strap from the third recess.

20. Apparatus according to claim 6, wherein it includes at least one support for the gripping means, the support being movable relative to the strapped articles and having at least one wedge formation which can be inserted between the straps and the strapped articles as a result of the relative movement of the support to cause the straps to be spaced from the strapped articles.

21. Apparatus according to claim 6, wherein it includes a detector which can identify the condition in which the straps have been received between the gripping means in order to activate the cutting means.

22. Apparatus according to claim 6, for removing straps from articles having a certain length between two opposite ends, wherein it includes a conveyor for advancing the articles towards the gripping means in substantially horizontal positions with at least one of the two opposite ends raised so as to bend the articles and consequently to render concave one side of the articles in correspondence with which the straps are spaced from the articles.

23. Apparatus according to claim 6, for removing straps from articles constituted by stacks of items held together by straps in the direction in which they are stacked and having two opposite ends, retaining boards around which the straps pass being applied to the opposite ends, wherein it includes:

a conveyor for supplying the articles in sequence towards the gripping means in a direction parallel to the direction of stacking;

spacer means for moving the facing ends of consecutive articles in the sequence slightly apart, and a removal unit for removing the retaining boards applied to the facing, spaced-apart ends of two consecutive articles in the sequence.

24. Apparatus according to claim 22, wherein a slider movable longitudinally of the conveyor is associated with the conveyor and can be brought into correspondence with the facing ends of two consecutive articles in the sequence so as to raise the ends from the conveyor and move the facing ends slightly apart.

25. Apparatus according to any one of claim 22, wherein it inlcudes separator means for spacing the articles apart before the at least one of the opposite ends is raised.

26. Apparatus according to claim 23, wherein a conveyor is associated with the removal unit for collecting the boards removed from the articles.

27. Apparatus according to claim 23, wherein the removal unit includes suction cup means which can act on the boards.

28. Apparatus according to claim 6, wherein it includes a plurality of lines for supplying strapped articles in flows which are side by side, and the gripping means have an associated movable support so that they can operate sequentially on strapped articles in different flows.

29. Apparatus according to claim 23, wherein it includes a plurality of lines for supplying strapped articles in flows which are side by side, and the removal unit is movable so that it can operate sequentially on strapped articles in different flows.

30. A method of removing straps from strapped articles including the steps of:

separating a strap which binds a strapped article from the article by separating means;

cutting the strap engaged by the separating means to provide a cut strap;

positioning a collecting means having a collecting recess adjacent said separating means, said collecting recess having a cylindrical configuration with a peripheral opening through which said cut strap is to be inserted, engaging said cut strap at a point spaced from a cut end by feed means;

feeding said strap into said recess by operation of said feed means; and coiling said cut strap within said recess.

31. A method of removing straps from strapped articles as set forth in claim 30, wherein said coiling of said cut strap is accomplished by positioning coiling means in said recess in engagement with said cut strap and rotating said coiling means to coil the cut strap within the recess.

32. Apparatus for removing straps from strapped articles including:

separating means for engaging a strap and separating a portion of said strap from said strapped articles;

cutting means for cutting the strap engaged by said separating means;

collecting means including at least one recess having a cylindrical configuration and provided with a peripheral opening through which a strap cut by said cutting means is to be inserted with said opening positoned to face said strap adjacent said separating means and drive means for advancing a cut strap cut by said cutting means into said recess.

33. Apparatus for removing straps from strapped articles as set forth in claim 32, further comprising coiling means extendable into said recess for engaging and coiling said cut strap within said recess.

* * * * *